US009849936B2

(12) United States Patent
Scanu et al.

(10) Patent No.: US 9,849,936 B2
(45) Date of Patent: Dec. 26, 2017

(54) CATAMARAN BOAT

(71) Applicants: John Scanu, Pisa (IT); Luca Rivieri, Viareggio (IT)

(72) Inventors: John Scanu, Pisa (IT); Luca Rivieri, Viareggio (IT)

( * ) Notice: Subject to any disclaimer, the term of this patent is extended or adjusted under 35 U.S.C. 154(b) by 0 days.

(21) Appl. No.: 15/501,347

(22) PCT Filed: Jul. 31, 2015

(86) PCT No.: PCT/IB2015/055832

§ 371 (c)(1),
(2) Date: Feb. 2, 2017

(87) PCT Pub. No.: WO2016/020814

PCT Pub. Date: Feb. 11, 2016

(65) Prior Publication Data

US 2017/0225747 A1 Aug. 10, 2017

(30) Foreign Application Priority Data

Aug. 4, 2014 (IT) ..... PI2014000056

(51) Int. Cl.
*B63B 3/08* (2006.01)
*B63B 1/12* (2006.01)

(52) U.S. Cl.
CPC . *B63B 3/08* (2013.01); *B63B 1/12* (2013.01)

(58) Field of Classification Search
CPC ..... B63B 7/04
See application file for complete search history.

(56) References Cited

U.S. PATENT DOCUMENTS 3,744,071 A * 7/1973 Bossier, Jr. ..... B63B 7/04
114/352

FOREIGN PATENT DOCUMENTS

BE 443241 A 5/1942
EP 2 679 482 A2 1/2014

* cited by examiner

*Primary Examiner* — Edwin Swinehart
(74) *Attorney, Agent, or Firm* — Vorys, Sater, Seymour & Pease LLP

(57) ABSTRACT

Provided is a nautical sector, in particular a catamaran boat including a first catamaran craft functioning independently, having a prevailing direction of longitudinal development along the median axis (x) and including a bow, a stern, motor means and directional means; a second catamaran craft functioning independently, having a prevailing direction of longitudinal development along the median axis (x) and including a bow, a stern, motor means and directional means, where said first catamaran craft and said second catamaran craft each include joining means for their mutual stable coupling, obtained matching the relative sterns, on a transverse junction plane (Π), to carry out said catamaran boat able to function as a single unit.

10 Claims, 7 Drawing Sheets

*Fig. 1*
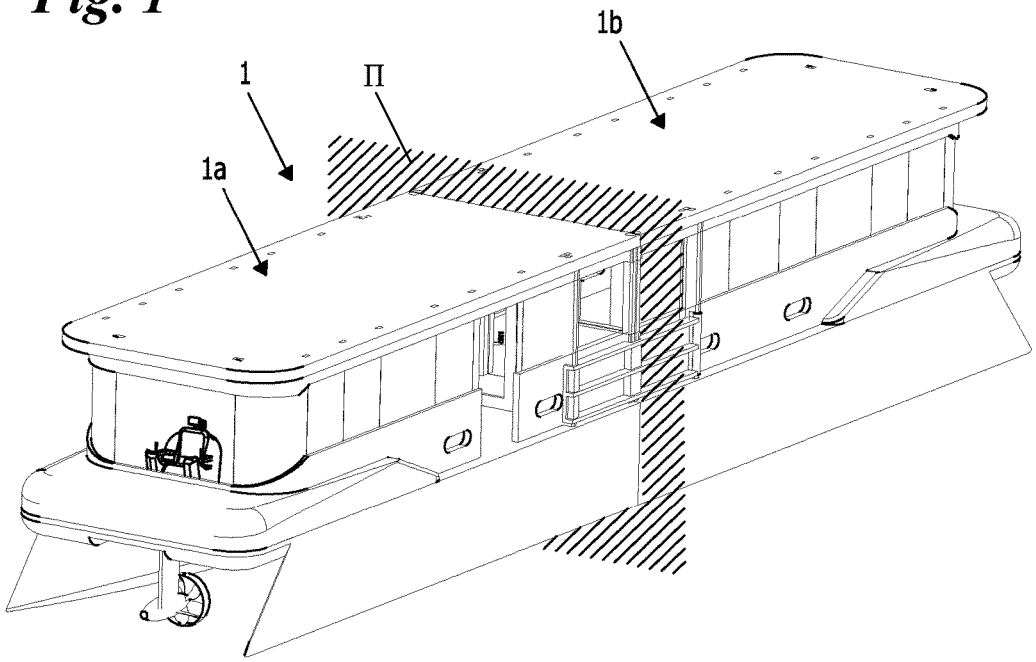
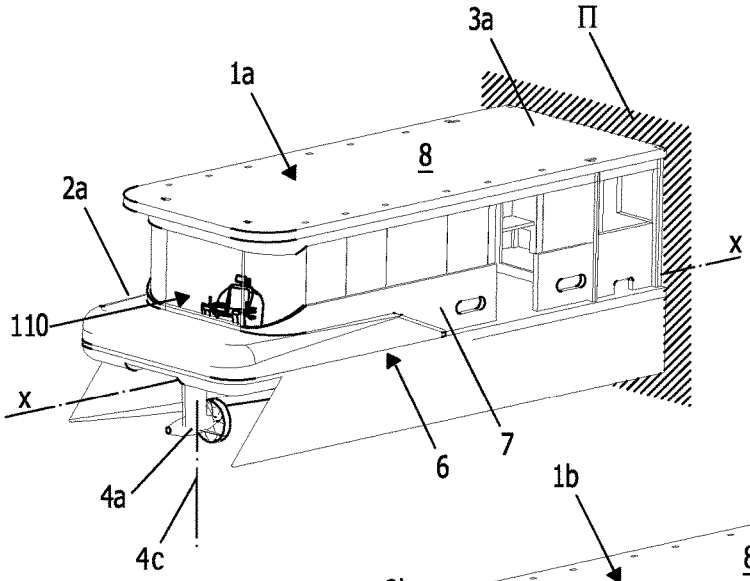
*Fig. 2a*
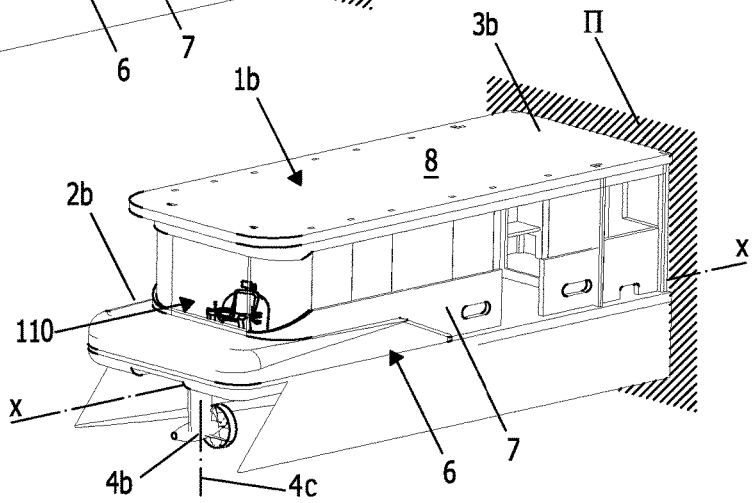
*Fig. 2b*

*Fig. 10*
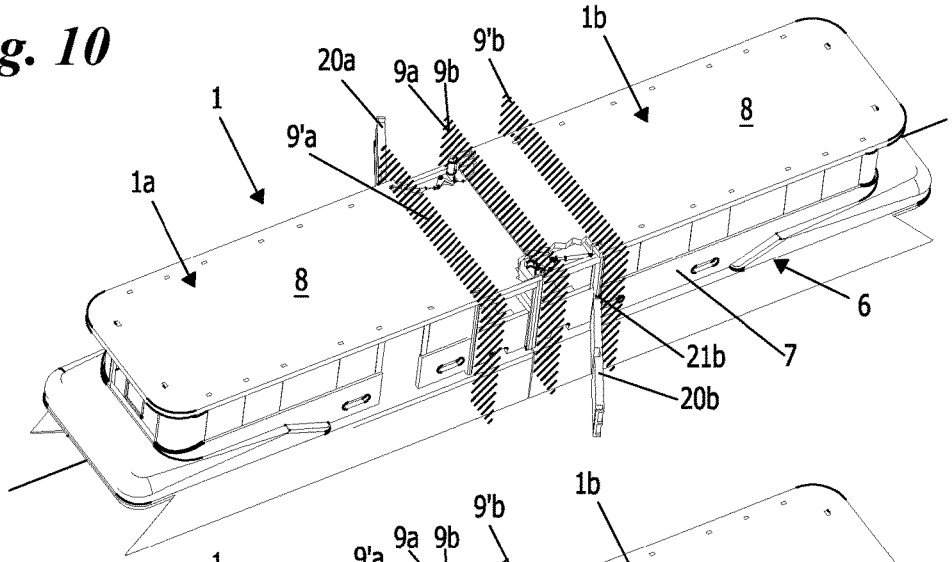
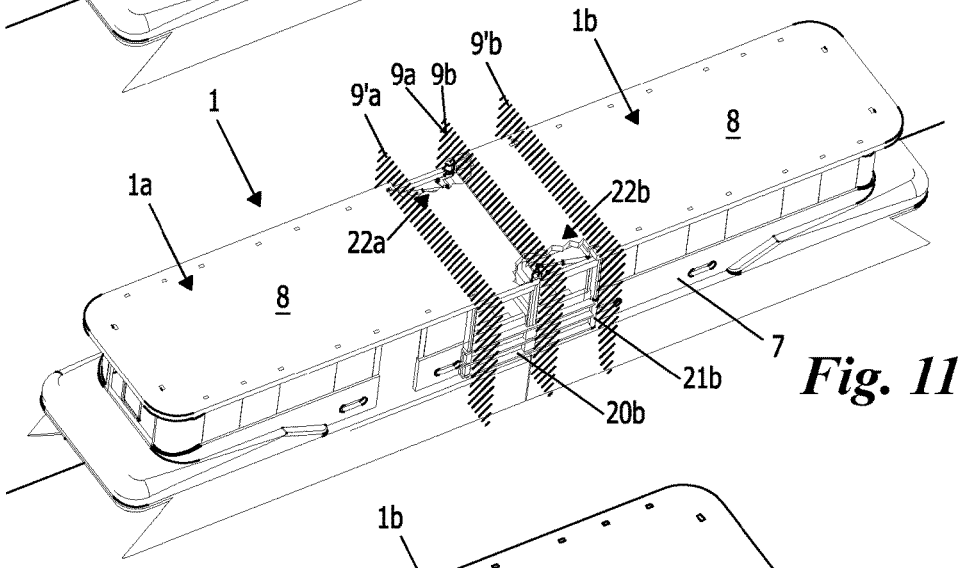
*Fig. 11*
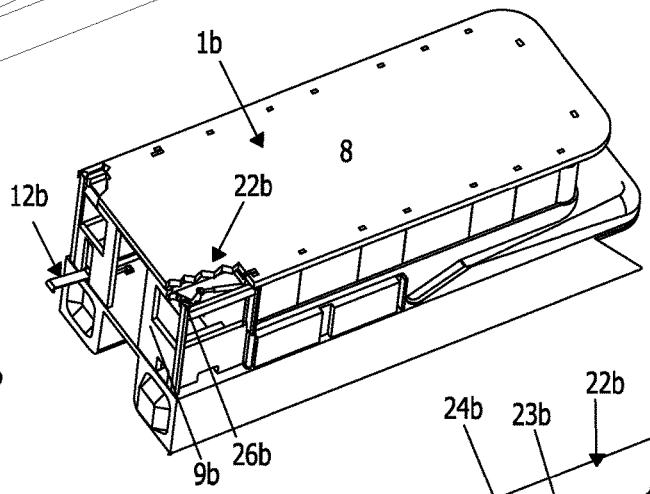
*Fig. 12*
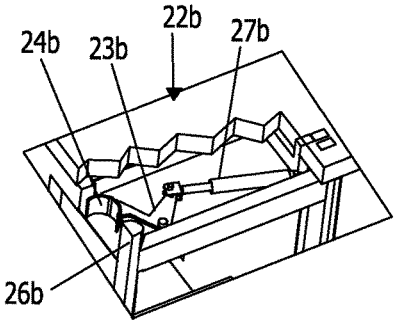
*Fig. 13*

*Fig. 18*
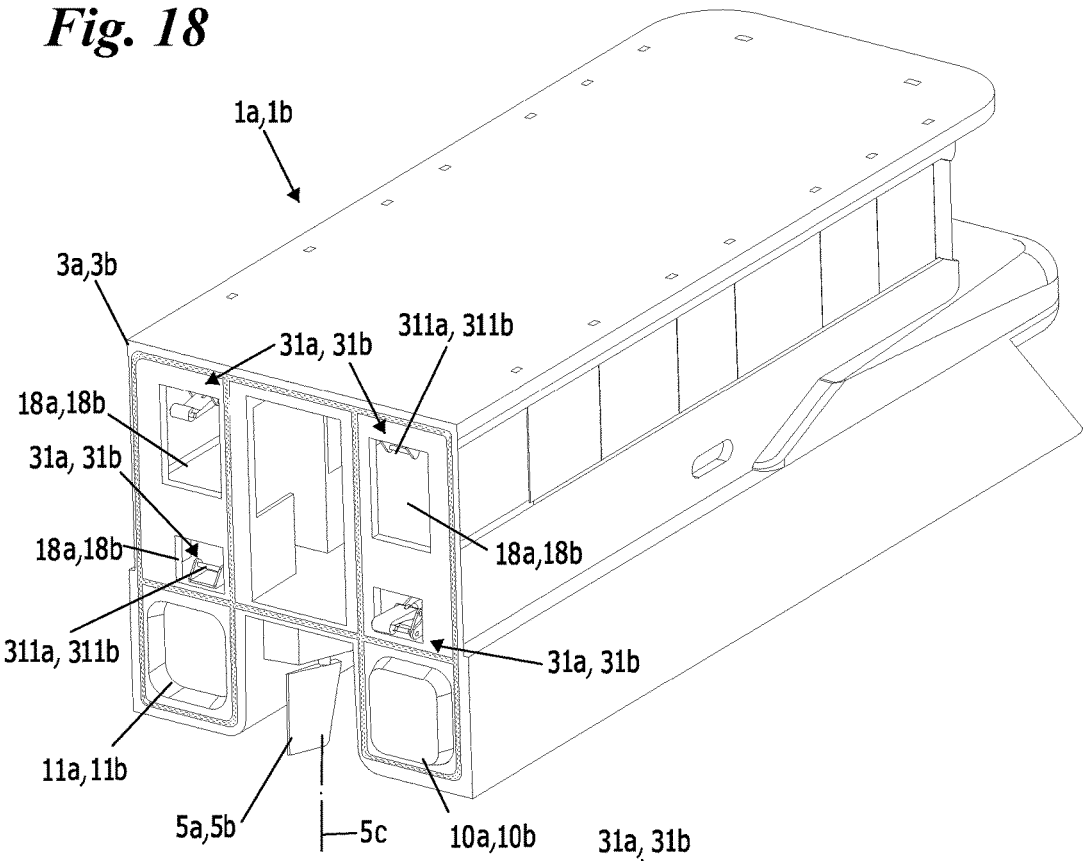
*Fig. 19a*
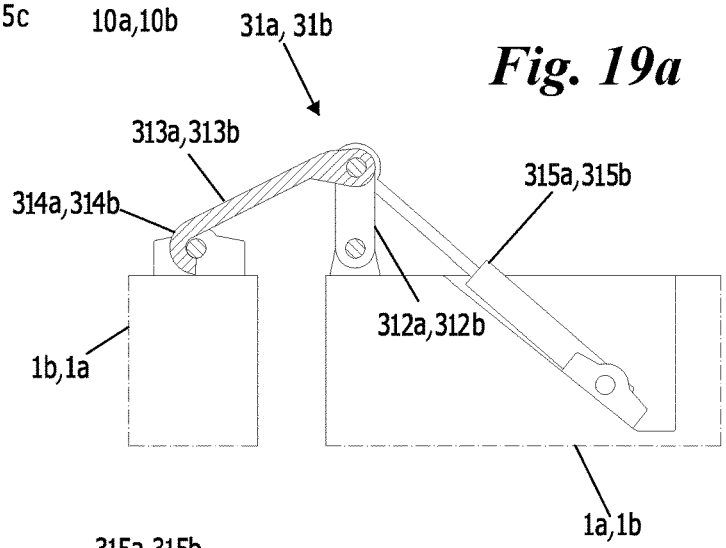
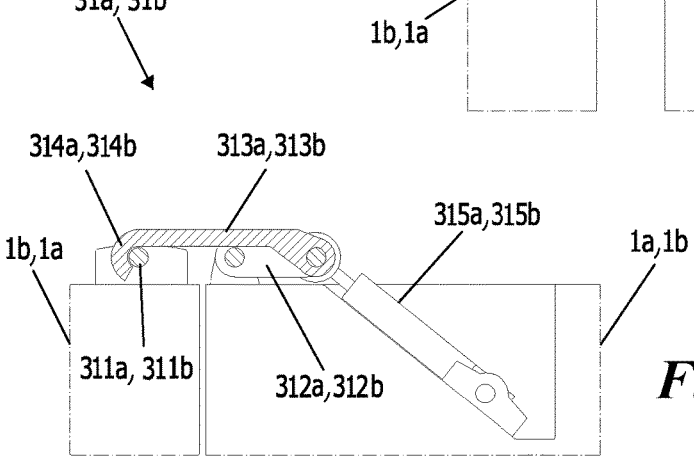
*Fig. 19b*

CATAMARAN BOAT

The present invention relates to a catamaran boat of the type specified in the preamble of the claim 1.

Each water transport means is currently being designed and built with the specific aim of carrying a maximum defined number of people and, therefore, with a definite weight and/or maximum load volume.

For any business, maximize profit results in optimizing the resources and the use of said means.

For this reason, those who develop a business in water transportation of things/people, should know precisely the flow density transported during the course of their works.

This estimate is not always easy to implement.

In fact, it may happen that the need to increase the load capacity of the water transport means takes place. This may happens also suddenly and/or for a variable time that can't be estimated a priori. Conversely, it may happen that, in some periods of the year, the demand is so limited that the water transport means are absolutely oversized for the mission, with unavoidable increase in operating costs and maintenance.

The load capacity variable can be really important, especially during some periods of the year. Considers, for example, the passengers transport activities close to the holiday periods in tourist areas: in this case the increase of the load capacity is limited to a few days. Alternatively, in the case of transport for commercial purposes of products, the increase of the load can be tied to the seasonal nature of such products, or affect time windows of amplitude undefined and unpredictable.

Disadvantageously, the traditional boats do not lend themselves to such versatility, with unavoidable increase in terms of operating costs. In some cases, the non-satisfaction of some requests, causes discontent loss of customers, economic and image disadvantages.

Another problem for the boats consists in the fact that, having to navigate even in routes particularly narrow (for example in a river, a channel, a harbor, etc.), they are very complex and hard working to handle.

In particular, this problem can be especially evident in the case of boats which, being dimensioned to have a considerable load capacity, have a high overall size and, therefore, require numerous and complex maneuvers to overcome an obstacle or a bend.

Under this situation, the technical task underlying the present invention is to provide a catamaran boat capable of substantially obviating the mentioned drawbacks.

Within the scope of this technical task, it is an important aim of the invention to have a modular catamaran boat, with a certain load flexibility, modulated in order to satisfy any condition of transport.

Another important aim of the invention is to realize a catamaran boat strong, sturdy, whose load capacity is variable easily and in conditions of maximum safety for the operators.

A further aim of the invention is to make a catamaran boat economic to manufacture and, moreover, characterized by a high simplicity of maneuvering. The technical task mentioned and the aims specified are achieved by a catamaran boats claimed in the appended Claim 1

Particularly, the objects are achieved with a catamaran boat characterized in that it comprises at least one catamaran craft defining a bow, a stern and comprising:

two side hulls each defining a median axis;

a supporting structure, named bridge, connecting and, in particular, subtended between the side hulls and defining a supporting surface;

an optional structure linked to the bridge at the top, defined superstructure and consisting of the side walls and ceiling;

motor means adapted to generate the thrust force of the catamaran boat and selectively arranged at the bow or at the stern;

directional means adapted to define, appropriately together with the motor means, the advancement direction of the catamaran boat and placed on the opposite side to the motor means and, therefore, at the stern or at the bow;

said motor and directional means are placed between the side hulls.

According to the first aspects of the invention:

said motor means comprise a azimuth thruster, said directional means comprise a rudder blade, wherein said motor means and said directional means are provided along said median axes According to a possible embodiment of the invention, the azimuth thruster of the catamaran craft rotates around a thrust axis substantially perpendicular to the supporting surface.

According to another possible embodiment of the invention, the rudder blade of the catamaran craft rotates around a directional axis substantially perpendicular to the supporting surface.

According to a further possible embodiment of the invention, the azimuth thruster rotation is controlled in a dependent way or, preferably, an independent way respect to the rotation of the rudder blade.

In more detail, the aims are achieved with a catamaran boat characterized in that it comprises:

a first catamaran craft that works independently, having a main direction of longitudinal development along a median axis and comprising a bow, a stern, motor means and directional means;

a second catamaran craft that works independently, having a main direction of longitudinal development along a median axis and comprising a bow, a stern, motor means and directional means, wherein both said first catamaran craft and said second catamaran craft comprise coupling means for their mutual stable connection, obtained by fitting their sterns together, on a transverse junction plane, in order to realize said catamaran boat adapted to work as a single unit.

According to the first aspects of the invention:

both the first and the second catamaran crafts defining a bow, a stern and comprising:

two side hulls; and a supporting structure connecting and, in particular, subtended between the side hulls and defining a supporting surface for the things and/or people to be carried with the catamaran boat; and an optional structure linked to the bridge from the top, defined superstructure and composed by the side walls and the ceiling;

motor means preferably comprising an azimuth thruster provided in the respective bow area of each catamaran craft;

directional means preferably comprising a rudder blade provided on the opposite side of the motor means and, in particular, in the respective stern area of each catamaran craft, where said motor means and said directional means are provided between the hulls and, in particular, along said median axes.

Advantageously, said first and said second catamaran craft are identical and the hull resulting from their junction is substantially symmetrical with respect to said junction transverse plane.

According to a further aspect of the invention, said coupling means comprise:

aligning means adapted to make the first and the second catamaran craft coaxial;

coupling means for said first end second catamaran crafts;

locking means adapted to make the coupling of said first and second craft stable and rigid.

In detail:

said aligning means comprise shape-coupling means provided at said sterns;

said coupling means work along the main direction of longitudinal development of said first craft and said second craft and comprise a movable hook provided on each craft, adapted to interact with a respective retaining element provided on the opposite craft; and said movable hook comprises a hydraulic or electric linear actuator able to exert a traction force to bring together said first and said second catamaran craft.

Moreover, said locking means comprise:

a panel pivotally associated to each catamaran craft and adapted to rotate in order to be stably fixed to the opposite catamaran craft;

a hook jaw provided on a covering wall of each catamaran craft and adapted to engage a respective retaining element formed by the coupling of said first and said second catamaran craft.

According to a possible embodiment of the invention, the azimuth thrusters of said first and second catamaran crafts rotate independently on respective axes to ensure the handling of said catamaran boat resulting from the union of the catamaran crafts.

According to the invention the main advantage of the catamaran boat lies in its modularity and flexibility.

A catamaran boat with a modular architecture, such as the one in question, can solve different requirements related to a daily or seasonally variable load capacity, a reduction of costs related to personnel on board, fuel and parking at the dock.

Each catamaran craft, in fact, provides by itself a well-defined load capacity, which may, however, be doubled if they are to form, once assembled, a single means of transport, that is to say a single catamaran boat.

This will determine the conditions for an operational flexibility that allows, in conditions of low traffic, to use separately the two catamaran crafts, for example by varying the mission profile of each craft, assigning to the two catamaran crafts different tasks on different routes, or simply sheltering one craft waiting for a new increase in traffic, with cost savings related to wear through exertion.

Instead, in heavy traffic conditions, it is possible to increase and, in detail, it double the capacity by matching two catamaran crafts, with minimal burden in terms of engaged crew and management costs of the catamaran boat.

An important advantage is represented by the fact that the catamaran craft, thanks to the innovative arrangement of the motor and directional means, ensures a high maneuverability to the catamaran boat.

In fact, their arrangement between the hulls ensures, in every condition, the presence of an optimal flow affecting the motor and directional means and, therefore, their optimum performance.

Furthermore, the possibility of exploiting, in addition to the rudder, an azimuth thruster to generate a torque rotating the catamaran craft and/or the catamaran boat, allows to considerably reduce the maneuvering spaces of the catamaran boat itself.

Another important aspect is the storage of the catamaran boat for extraordinary maintenance operations. The operation performed in two stages, separately for the two catamaran crafts, allows two advantages: on the one hand it reduces the cost of lifting and positioning on site, having to move a smaller load, with reduced use of lifting equipment and less occupied spaces, on the other hand it allows to not completely stop the activity because of the use of the catamaran boat.

The coupling of two catamaran crafts imposes geometric characteristics appropriate of the respective aft zones, for which it is extremely advantageous to use catamaran crafts with a hull of the catamaran type.

The catamaran hull, in fact, allows the installation of steering bodies suitably arranged in the stern area and, if positioned between the side hulls and, in particular, on the axis of symmetry of the catamaran boat, they are especially efficient. In the traditional hulls it occurs instead that the maneuver bodies, in most cases, protrude from the aft end to the outside, thereby preventing a possible combination of the sterns of the two catamaran crafts.

The use of catamaran hulls also allows a more efficient coupling and a structurally more resistant constraint.

The two independent catamaran crafts are mutually identical. This characteristic is essential for operating a correct positioning there between during the mutual approach, even in case of minimum headway, and then ensuring, thanks to the structural symmetry and fair distribution of the weights derived there from, an optimal, stable and rigid constraint.

Furthermore, the use of two identical catamaran crafts allows, once assembled, to assign either one or the other the main control functions, with a more convenient maneuverability of the catamaran boat. The captain may, in fact, choose the command post between the two existing and equivalent, simply basing on the specifics of mission, and from said control post he can access all systems on board.

The fact that the two catamaran crafts are identical is extremely advantageous also for the ship production, basically for two aspects: on the one hand, mass-producing always the same catamaran boat greatly reduces the costs related to the production process; on the other, it is possible to meet very different requirements, with respect to the volume of cargo to be transported, reducing time, space and job costs.

Advantageously, the above-described variation of the capacity of people and/or things transport can be increased by realizing a catamaran boat, adding to catamaran crafts one or more intermediate catamaran crafts, able to be connected permanently between the catamaran crafts, and/or adding at least one additional catamaran craft able to bind to the stern of a catamaran craft.

The distribution and shape of the coupling means is extremely favorable for the structural rigidity of the assembled catamaran boat, as it will be highlighted in the following description.

Preferred embodiments are highlighted in the sub-claims.

The characteristics and advantages of the invention are clarified below by the detailed description of one or more preferred embodiments of the invention, with reference to the accompanying drawings, in which:

FIG. 1 represents, in an axonometric view, a catamaran boat according to the invention;

FIG. 2*a* shows a component of the catamaran boat of FIG. 1;

FIG. 2*b* shows a different component part of the catamaran boat of FIG. 1;

FIG. 3*a* shows a different view of the component of FIG. 2*a;*

FIG. 3*b* is a different view of the component of FIG. 2*b;*

FIG. 4 presents another axonometric view of the component of FIG. 3*b;*

FIG. 10 shows, in axonometric view, the catamaran boat;

FIG. 11 shows the catamaran boat in a different time with respect to FIG. 10;

FIG. 12 shows some parts of the component of FIG. 2*b;*

FIG. 13 is an assembly of the catamaran boat distinguished from that of FIG. 8;

Figure 16A:
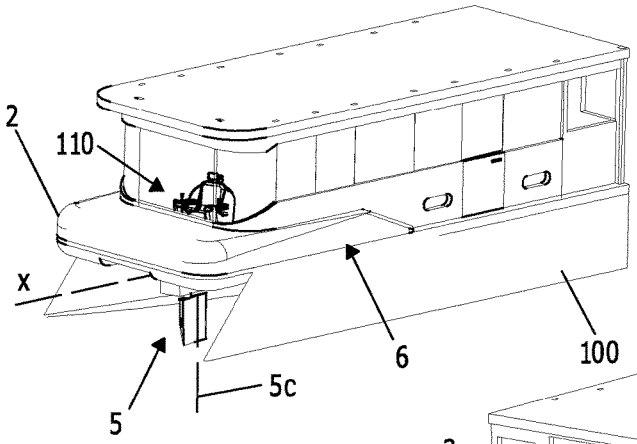
Figure 16B:
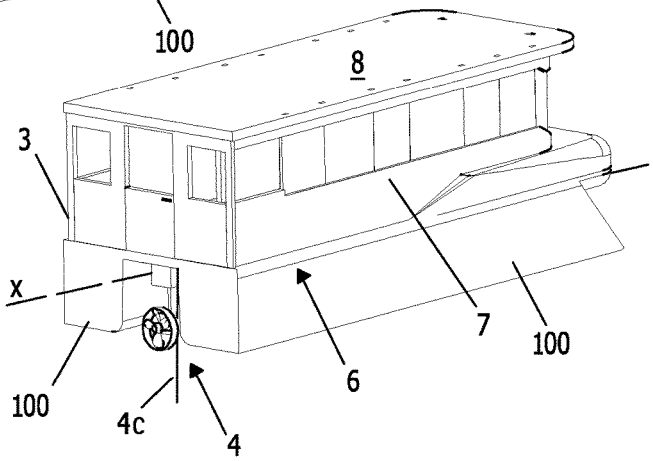

FIG. 16*a* shows a further example of catamaran boat according to the invention;

FIG. 16*b* shows another view of the catamaran boat of FIG. 16*a;*

Figure 17A:
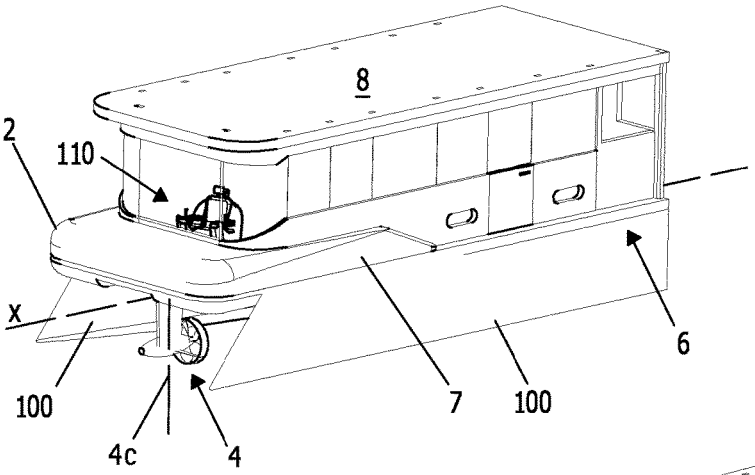
Figure 17B:
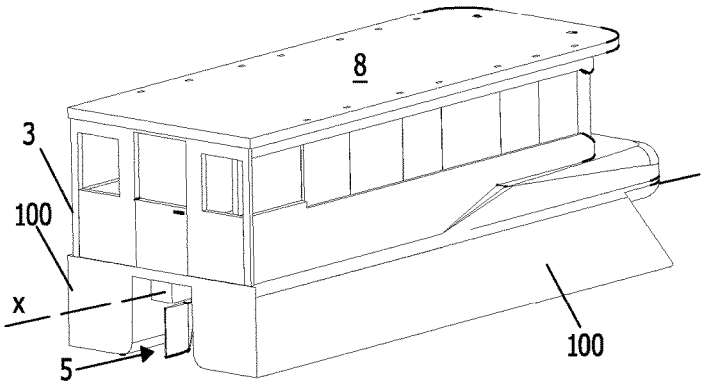

FIG. 17*a* is an additional example of catamaran boat according to the invention;

FIG. 17*b* shows another view of the catamaran boat of FIG. 17*a;*

Figure 7:
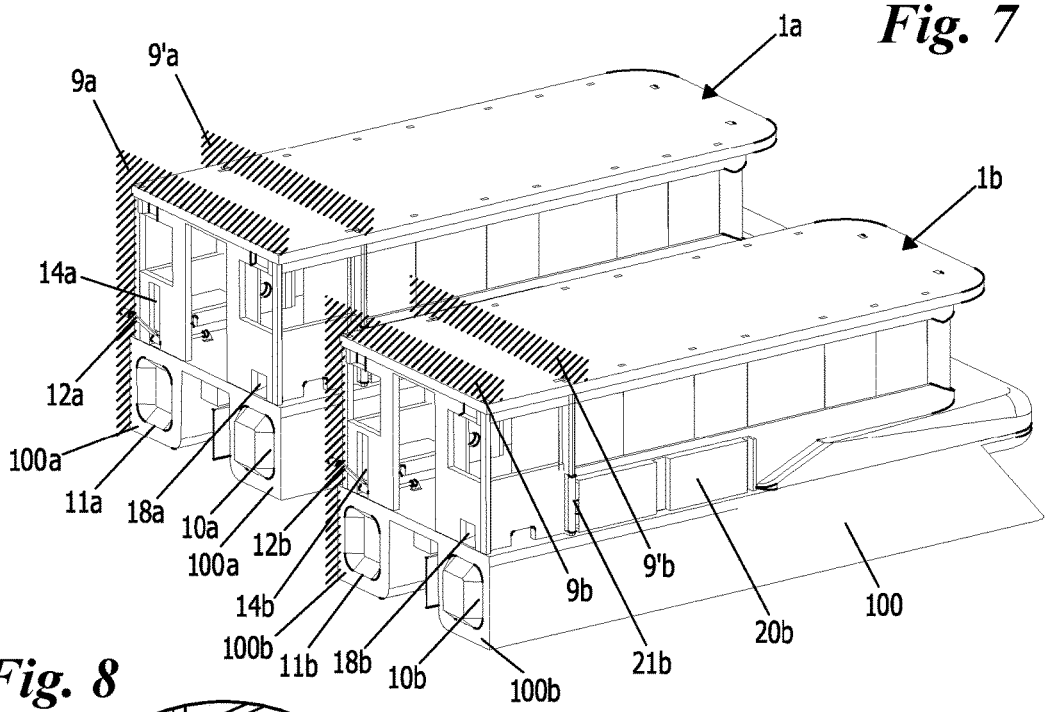
FIG. 7 shows the components of FIGS. 2*a* and 2*b* side by side.

FIG. 18 shows an assembly alternative to that of FIG. 7;

FIG. 19*a* is a detail of FIG. 18; and

FIG. 19*b* is the detail of FIG. 18*a* in a different position.

In this document, measures, values, shapes and geometric references (as squareness and parallelism), when associated to words such as "about" or similar terms such as "almost" or "substantially", are to be intended as measurement errors or inaccuracies due to production and/or manufacture errors and, above all, with the exception of a slight divergence from the value, from the size, from the shape or from the geometric reference which it is associated. For example, such terms, when associated to a value, preferably indicate a divergence of no more than 10% of the value itself.

Furthermore, when used, terms such as "first", "second", "upper", "lower", "main" and "secondary" do not necessarily identify an order, a priority of relationship or relative position, but can simply be used for more clearly distinguish between them different components.

With reference to the mentioned figures, the catamaran boat according to the invention is globally indicated with the number 1.

It is designed to be used for the sea navigation or in inland waters (or protected). In particular, the catamaran boat 1 can be, therefore, apt to be used for navigation along a waterway, that is a navigable canal, of natural or artificial origin, used to manage the vessel traffic such as, for example, a river or a lake.

Figure 3A:
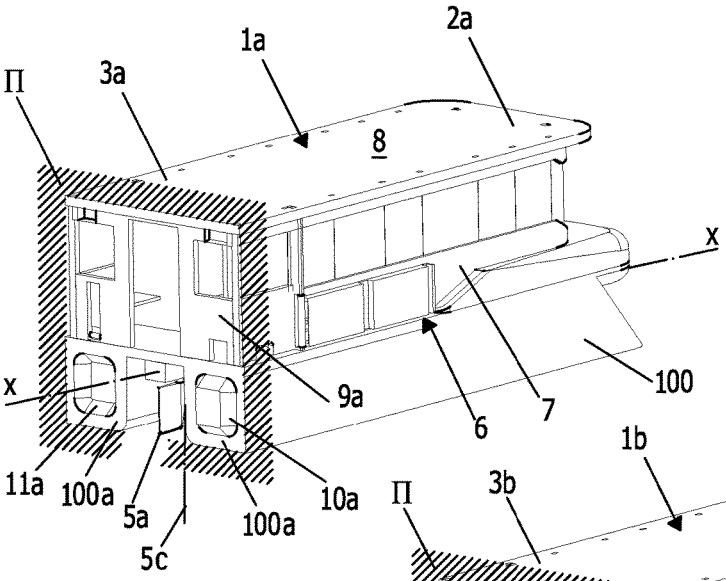
Figure 3B:
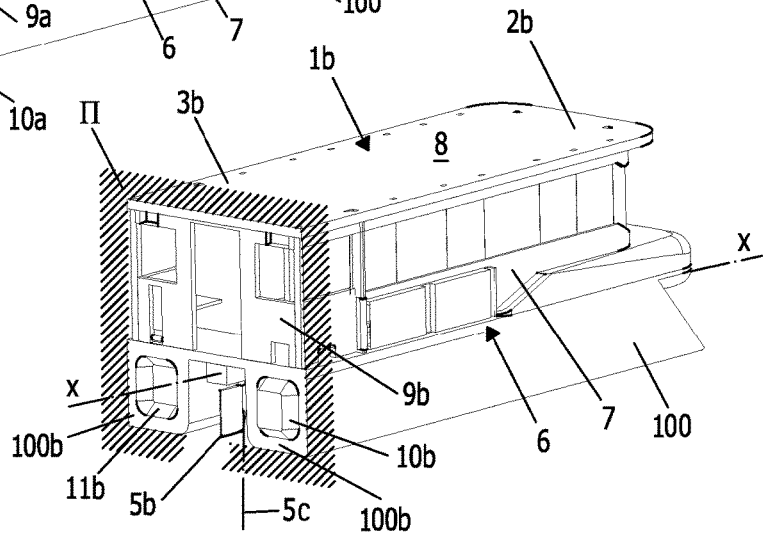

The catamaran boat 1 comprises at least one catamaran craft and, preferably, two catamaran crafts, namely a first catamaran craft 1*a* (FIGS. 2*a* and 3*a*) and a second catamaran craft 1*b* (FIGS. 2*b* and 3*b*). In particular, it is obtained by the stable connection of two catamaran crafts 1*a*, 1*b* substantially identical, both having a catamaran hull and each defining a median axis x.

Each of said catamaran crafts 1*a*, 1*b* comprises a bow 2*a*, 2*b*, a stern 3*a*, 3*b*, and at least one among the motor means 4*a*, 4*b* and directional means 5*a*, 5*b*. In particular, the first catamaran craft 1*a* can act independently and therefore comprises a first bow 2*a*, a first stern 3*a*, first motor means 4*a*, first directional means 5*a* provided along the prevailing direction of longitudinal development of the same catamaran craft, coinciding with a median axis x; while the second catamaran craft, also functioning independently; comprises a second bow 2*b*, a second stern 3*b*, and one between the second motor means 4*b* and second directional means 5*b*. Preferably, each catamaran craft 1*a*, 1*b* is functioning independently and therefore comprises a bow 2*a*, 2*b*, a stern 3*a*, 3*b*, and motor means 4*a*, 4*b* and directional means 5*a*, 5*b* provided along the prevailing direction of longitudinal development of the same catamaran craft, coinciding with a median axis x.

Preferably, each catamaran craft 1*a* and 1*b* presents a control station (namely a wheelhouse) 110 suitably connected to the means 4*a*, 4*b*, 5*a* and 5*b* so as to control direction and speed of advance of the catamaran craft 1*a* and 1*b* and, in particular, of the catamaran boat 1.

Said motor means 4*a*, 4*b* comprises, for each catamaran craft 1*a* and 1*b*, an azimuth thruster provided in the respective bow area 2*a*, 2*b*, while said directional means 5*a*, 5*b* comprises, for each catamaran craft, a rudder blade provided in the respective aft area 3*a*, 3*b*.

The motor means 4*a*, 4*b* comprises an, azimuth thruster, conveniently, adapted to rotate on a thrust axis 4*c* preferably substantially perpendicular to the supporting surface thus varying the direction of the thrust force.

The directional means 5*a* and 5*b* comprise a rudder blade, suitably, adapted to rotate on a directional axis 5*c* preferably substantially perpendicular to the support surface thus varying the direction of advance.

The axes 5*c* and 4*c* are substantially parallel to each other, in particular, lie on a plane almost parallel to the median axis x. Preferably, the axis 4*c*, 5*c* and *x*, lies substantially on a single plane.

The means 4*a*, 4*b*, 5*a* and 5*b* and, in particular, the azimuth thruster and the rudder blade are adapted to rotate independently one another as to allow each catamaran craft 1*a* and 1*b* and, therefore, the catamaran boat 1 to selectively move along a transverse direction and, in some cases, perpendicular to the median axis x, advance along the median axis x, almost to roto-translate and, in detail, almost to rotate.

The hull of each catamaran craft 1*a*, 1*b* comprises a supporting structure 6, consisting of a bridge and, preferably, of a superstructure formed by the sidewalls 7 and a ceiling 8.

The structure of the aft area 3*a*, 3*b* of each catamaran craft 1*a*, 1*b* is plain and is opportunely tightened to accommodate the coupling means and the required bodies for coupling.

Each catamaran craft 1*a*, 1*b* also comprises two side hulls 100 on which it is leaned and among which the structure 6 essentially underlies.

The side hulls 100 of each craft 1*a*, 1*b* have an extremity defining a contact face 100*a* and 100*b* adapted to make contact with the respective contact face 100*b* and 100*a* of the other catamaran craft 1*a* and 1*b*; and, suitably, the other extremity tapered so to facilitate the movements of the catamaran boat 1 and/or of the single catamaran craft 1*a* and 1*b*.

The contact faces 100*a* and 100*b* are parallel between them and, in detail, substantially conforming to each other in shape so as to lean mutually and, therefore, facilitate the linkage between the catamaran crafts 1*a* and 1*b*.

It is shown how the means 4*a*, 4*b*, 5*a* and 5*b* are preferably constrained to the supporting structure 6 and, suitably, placed between the side hulls 100.

Figure 4:
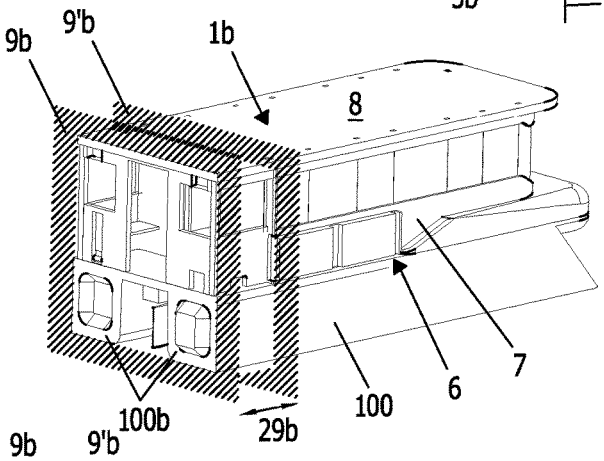
Figure 5:
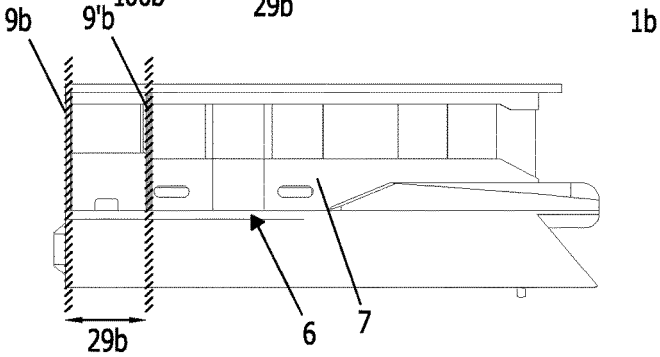
FIG. 5 is a side view of the component of FIG. 3*b;*

With reference to FIGS. 4, 5 and 7, each catamaran craft 1*a*, 1*b* comprises two transverse bulkheads 9*a* and 9'*a*, 9*b* and 9'*b*, placed at the last two structural frames of the supporting structure 6 confined in the aft area 3*a*, 3*b*.

Such bulkheads 9*a* and 9'*a*, 9*b* and 9*b*, identify a compartment 29*a*, 29*b* at the end of the stern 3*a*, 3*b* of each single catamaran craft 1*a*, 1*b* where must take place all joining operations in order to obtain a single catamaran boat 1.

Through appropriate structural stiffening located in the compartments 29*a*, 29*b*, on the bulkheads 9'*a*, 9*a*, 9*b* and 9'*b* the stresses that are produced once the catamaran crafts 1*a* and 1*b* are assembled are discharged.

Said first catamaran craft 1*a* and said second catamaran 1*b* each comprise coupling means for their mutual stable coupling, obtained matching the relative sterns 3*a*, 3*b*, in a transversal junction plane Π (FIGS. 1, 2*a*, 2*b*, 3*a* and 3*b* and 6). The contact takes place between the two outer stern bulkheads 9*a*, 9*b* of each catamaran craft.

Figure 6:
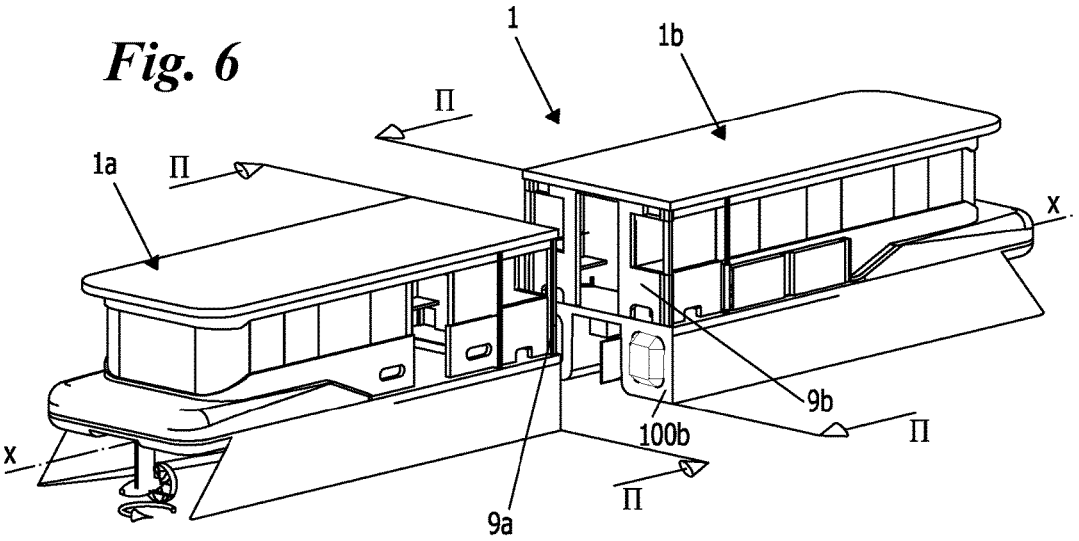
FIG. 6 shows, in axonometric view, the catamaran boat of FIG. 1 during a step of assembly.

Said coupling means comprise:

- alignment means adapted to make coaxial said first and second catamaran craft 1*a*, 1*b;*
- coupling means for said first and second catamaran craft 1*a*, 1*b;*
- locking means adapted to make stable and rigid the coupling of said first and second catamaran craft 1*a*, 1*b*; and, suitably,
- connectors adapted to allow a passage data/energy between the catamaran crafts and, therefore, to a control station to control all directional and motors means of a catamaran boat;

In addition the coupling means preferably comprise at least one gasket adapted to interpose between the units 1*a* and 1*b* avoiding the entry of water between the catamaran crafts when mutually bounded by coupling means and especially to compensate possible tolerance as well as deformations of the contact bulkheads. With particular reference to FIGS. 6 and 7, said alignment means comprise means of shape-coupling provided on the respective bulkheads 9*a*, 9*b* of the external area of the stern 3*a*, 3*b* of each catamaran craft 1*a*, 1*b*.

Said form coupling means work in correspondence of said junction transverse plane Π.

Each catamaran craft 1*a*, 1*b* comprises, on its external stern bulkhead 9*a*, 9*b* and, in particular, on the contact faces 100*a* and 100*b*, a truncated pyramidal structure 10*a*, 10*b* which protrudes toward the outside of the stern 3*a*, 3*b* and a recess conformed 11*a*, 11*b* proceeds instead in the same stern. Said truncated pyramidal structure 10*a*, 10*b* and said recess conformed 11*a*, 11*b* have complementary section so as to cooperate with sliding of the respective inclined planes during the headway action.

Therefore, the first catamaran craft 1*a* comprises on a contact face 100*a* a truncated pyramidal structure 10*a* and on the other contact face 100*a* a recess conformed 11*a*; while the second catamaran craft 1*b* comprises on a contact face 100*b* a structure like a truncated pyramidal and on the other face 10*b* of contact 100*b* a recess conformed 11*b*.

It is highlighted that on the structures 10*a* and 10*b* could be arranged the connectors, so that, when the catamaran craft 1*a* and 1*b* are joined, the joined connectors realizes a data transfer/energy between the catamaran craft 1*a* and 1*b*. Alternatively, they may be placed on bulkheads 9*a* and 9'*a*, 9*b* and 9'*be*, suitably, above the waterline of the boat catamarana 1.

Moreover, each catamaran craft 1*a*, 1*b* may comprise, suitably placed on the external stern bulkhead 9*a*, 9*b*, at least one gasket adapted to engage itself on the other gasket placed on the other units 1*a* and 1*b* so as to hermetically seal the catamaran boat 1, compensating deformations.

Preferably, the gasket, housed within a suitable recess on the stern bulkhead, is placed along a first semi-perimeter of the first unit 1*a* and along a second semi-perimeter of the second unit 1*b* so that, when the units are mutually bonded by the coupling means, the two gaskets are distributed along all the perimeter hermetically sealing the catamaran boat 1, compensating deformations.

Once the two catamaran crafts 1*a*, 1*b* are coupled, the truncated pyramidal structure 10*a* of said first catamaran craft 1*a* will be inserted in the recess conformed 11*b* of said second catamaran craft 1*b*, while the recess 11*a* of said first catamaran craft 1*a* will host the truncated pyramidal structure 10*b* of the second catamaran craft 1*b*. In this way the two sterns 3*a*, 3*b* will match each other, preferably substantially perfectly, the respective median axes x of the catamaran crafts 1*a* and 1*b* will coincide and the entire catamaran boat 1 will thus be substantially symmetrical with respect to the transverse plane of junction Π.

Figure 8:
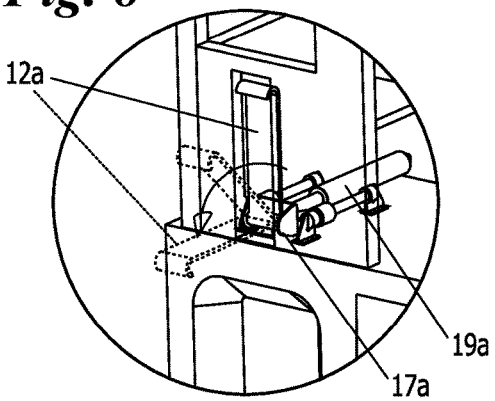
FIG. 8 is an assembly of the catamaran boat.
Figure 9:
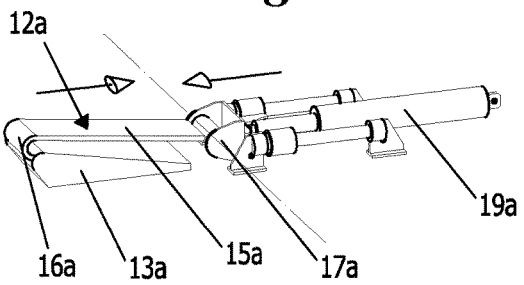
FIG. 9 shows a sub-assembly of FIG. 8.

With particular reference to FIGS. 7, 8 and 9, said coupled means comprise a movable hook 12*a*, 12*b* provided on each catamaran craft 1*a*, 1*b* and adapted to interact, orthogonally to said junction plane transverse Π, with a respective retention cuneiform element 13*a*, 13*b* provided on the opposite catamaran craft. When the two catamaran crafts 1*a*, 1*b* are operating separately, each hook 12*a*, 12*b* is housed inside a suitable place 14*a*, 14*b* formed in the compartment 29*a*, 29*b* defined by the stern bulkheads 9*a* and 9'*a*, 9*b* and 9'*b*, of the respective catamaran craft (FIG. 7), while in the use said hook 12*a*, 12*b* is adapted to be disposed, rotating, orthogonally to the respective outer stern bulkhead 9*a*, 9*b* (FIG. 8).

Said hook 12*a*, 12*b* is constituted by an arm 15*a*, 15*b* fitted with a hooked end 16*a*, 16*b*, and is connected to the opposite end to a sliding hinge 17*a*, 17*b* in the stern compartment 29*a*, 29*b*.

Said restraining element 13*a*, 13*b* is as the same time provided along a vane 18*a*, 18*b* realized at the compartment 29*a*, 29*b* of each catamaran craft 1*a* and 1*b*.

The coupling takes place when said arm 15*a*, 15*b*, sliding in said seat 18*a*, 18*b*, reaches with its hooked end 16*a*, 16*b* said retention element 13*a*, 13*b* and engages itself as shown in FIG. 9.

Once the hooked tail of the arm 16*a*, 16*b* has overcome said retention element 13*a*, 13*b* and, a hydraulic piston 19*a*, 19*b*, provided at the opposite end of the hook arm, through the hinge sliding 17*a*, 17*b*, exerts a traction force in approaching such as to keep the two sterns 9*a*, 9*b*, and then the two catamaran craft 1*a*, 1*b*, tightened among them.

Said locking means comprise a panel 20*a*, 20*b* pivotally associated on the left of each catamaran craft 1*a*, 1*b* and adapted to be stably fixed on the opposite catamaran craft 1*a*, 1*b* (FIGS. 7, 10, 11).

Said panel 20*a*, 20*b* is associated, through a hinge with a vertical axis 21*a*, 21*b*, to the outside of the structural bulkhead 9'*a*, 9'*b* facing the stern.

Said panel 20*a*, 20*b*, by rotating about said hinge 21*a*, 21*b*, is adapted to be fixed stably on the whole both of the two aft bulkheads 9*a* and 9*b* that the structural bulkhead 9'*a*, 9'*b* facing the aft one, on the opposite catamaran craft. In this way both structural compartments 29*a*, 29*b* of the two opposite catamaran craft 1*a*, 1*b* working together in equal measure to the effort generated by the assembly.

The same function of stable fixing between the catamaran craft 1*a*, 1*b* is ensured also by additional locking means realized with a hook jaw 22*a*, 22*b* provided within the coverage plan 8 of the hull of each catamaran craft (FIGS. 10-14).

Said hook is substantially constituted by a lever arm 23*a*, 23*b* to one end of which is provided with a jaw 24*a*, 24*b* adapted to cooperate engaging a corresponding retention element 25.

Said retaining element is obtained by a suitable shaping 26*a*, 26*b* of the upper portion of each exterior stern bulkhead 9*a*, 9*b* in such a way that, in the mating position, the two shaped portions 26*a* and 26*b*, matching between them, realize a semi-cylindrical retaining element 25 perfectly engaged by the respective jaw tightening.

Said rectilinear lineament with a semi-cylindrical geometry 25 is therefore the result of the combination of the two external bulkheads 9*a*, 9*b* of the stern of each catamaran craft 1*a*, 1*b* and is positioned on their upper extremity.

Once hooked, a hydraulic piston 27*a*, 27*b* provided at the opposite end of the lever arm 23*a*, 23*b* allows to exercise a grip such as to tighten said jaw 24*a*, 24*b* around said retention element 25 and maintain tight, one against the other, the projecting portions 26*a*, 26*b* of the two external stern bulkheads 9*a* and 9*b* (FIG. 14), thus adding a further locking element to the two catamaran crafts 1*a*, 1*b* and ensuring a pair still more stable and safe.

The assembling of the catamaran boat 1 takes place in three distinct phases:

- approaching of said first and said second catamaran craft 1*a*, 1*b* (FIG. 6),
- aligning and coupling of the two catamaran crafts 1*a*, 1*b* (FIGS. 6, 8 and 9);
- looking stable and secure of the two catamaran craft 1*a*, 1*b* to realize the single catamaran boat 1 (FIGS. 10, 11).

The approaching operation between the sterns of the catamaran crafts 1*a*, 1*b*, before the mechanical coupling, can be performed with the aid of the motor means and the directional means. The azimuth thruster at the bow and the rudder blade at the stern of each catamaran craft act in synergy allowing, even with little headway, the correct positioning of the two catamaran crafts, and the mutual alignment, so that the respective median axes x, which are extended along the longitudinal direction of development of each catamaran craft, coincide (FIG. 6).

The optimal conditions to perform them approaches maneuvers provide calm water and are therefore to be executed in port areas.

During the aligning operation, an operator disengages the hooks 12*a*, 12*b* of the two catamaran crafts 1*a*, 1*b* from their vanes, by turning them up to arrange them in a horizontal position, at right angles to the respective draft bulkheads. This operation could also be automated (FIGS. 7 and 8).

When the complete rotation has been operated, from each catamaran craft 1*a*, 1*b* protrudes the hook 12*a*, 12*b* of the coupling at the stern, according to the direction of longitudinal development.

In the early stages of approaching, the headway allows to the extended hooks to slide inside the corresponding seats 18*a*, 18*b* formed in the bearing structure of the opposite catamaran craft 1*a*, 1*b* up to achieve the holding elements 13*a*, 13*b*. Once, thanks to headway, the two hooks are inserted in their vane and they have hooked the holding elements, the operator actuates the electric or hydraulic system which, by moving the piston 19*a*, 19*b* of each arm, close the hooks on the relative holding elements (FIG. 9) bringing into stable contact the two catamaran craft.

To guarantee the final centering the two pyramidal structures 10*a*, 10*b* projecting from stern bulkheads of each catamaran craft are inserted into the corresponding opposing recesses 11*a*, 11*b*, avoiding the dangers of accidental rotations and misalignments and, preferably, contributing to the transfer of shear stresses.

After the centering phase, the two catamaran crafts 1*a*, 1*b* are perfectly combined with the stern bulkhead matching to define the cross junction plane Π.

The target of the locking phase is to ensure the relative position reached by the aligning on a stable, structurally safe and definitive manner, in order to consider the catamaran boat so assembled a single unit from the architectural point of view (FIGS. 1, 10 and 11).

In the example primary for locking has been considered the actuation of the revolving panels and secondary the tightening of the coupling jaws. Nothing would change if the drive of the elements were reversed.

The panels 20*a*, 20*b* of each catamaran craft 1*a*, 1*b* are disengaged from their vanes and made to rotate around their hinges with a vertical axis 21*a*, 21*b* up to adhere to the opposite side of the catamaran craft engaging to it in correspondence of its structure, in particular on structural bulkheads defining the compartments 29*a*, 29*b*.

After the rotation of the panels, they act the jaws 24*a*, 24*b*.

When the locking is completed the two catamaran craft are a single catamaran boat with on board systems manageable by a single control station 110, wheelhouse, chosen by the commander among the two available.

Each board system (sprinkler system, bilge system, fresh water system, sewage system, electrical system, fuel system, etc.) is designed in a modular way, with control units placed in the control station 110, as to take indifferently the function of master or slave.

The captain can choose the control station 110 between the two existing and equivalent, simply according to the specific mission, and from the same he can have access to all onboard systems, comprising propulsion.

The catamaran boat 1 assembled is in fact equipped with two azimuth thrusters 4*a*, 4*b*, arranged at the ends of the resulting hull. The rudder blade 5*a*, 5*b* in this configuration remain locked in position along the longitudinal axis of the catamaran boat and therefore do not cooperate to the motion.

The captain, with the aid of a joystick, decides the maneuvers to be executed. A suitable control system, depending on the physical and geometrical characteristics of the catamaran boat, can act on the motors according to the maneuver, by imposing on them thrust and rotation.

In detail, the azimuth thrusters of said first and second catamaran craft can rotate on their respective axes either independently or in a coordinated and dependent way for moving said catamaran craft.

By way of example, the fundamental maneuvers that can perform the catamaran boat 1 are reported: translation, turning and turning on site.

During translation, the catamaran boat 1 moves his center of gravity along a straight line while maintaining the fore-aft direction constant. The angle between the movement direction and the fore-aft direction may vary between 0 and ±180°. To drive along a straight line it is necessary to rotate both thrusters by the same angle, both in module and in sign.

During the turn, the catamaran boat 1 moves his center of gravity on a tangent to the curve while maintaining the same fore-aft direction. To make a turn the two thrusters can act dependent or independent from each other. In the case of dependence both will rotate by the same angle in module, but with opposite direction. In the case of independence the azimuth thrusters will rotate with different angles in modulus and sign. A particular case of turn can be obtained by rotating a thruster only.

Finally, during the rotation on site, the boat catamarana, with center of gravity fixed, rotates the fore-aft direction: to perform a rotation on site both the thrusters must be rotated of the same angle equal to 90°, in opposite directions.

Optionally, the catamaran boat 1 comprises, in addition to catamaran craft 1*a* and 1*b*, one or more intermediate catamarans craft 1*c* adapted to be interposed between the catamarans craft 1*a* and 1*b* and, therefore, to further increase the load capacity of the catamaran boat 1. in this case, the catamaran boat 1 is obtained by the stable coupling of two catamaran craft 1*a*, 1*b* substantially identical, and, among the catamaran craft 1*a* and 1*b*, one or more intermediate catamaran craft.

Each intermediate catamaran craft 1*c* comprises an intermediate catamaran hull and defines an intermediate bow, an intermediate transom and an intermediate middle axis. In particular, it is a multihull and comprises two intermediate lateral hulls 28*e*, an intermediate support structure 29 coated by intermediate sidewalls and an intermediate ceiling.

In some cases the intermediate catamaran craft 1*c* may comprise an intermediate control station and at least one, among intermediate motor means and intermediate directional means, placed on the bow and/or on the stern and substantially similar to the aforesaid means 4*a*, 4*b*, 5*a* and 5*b* of the catamaran craft 1*a* and 1*b*. Preferably, the intermediate catamaran craft 1*c* comprises a control station and intermediate motor means and intermediate directional means places on opposite sides, that are fore and aft.

In addition, each intermediate craft catamaran 1*c* comprises, at the intermediate bow and stern, the intermediate coupling means able to allow to link intermediate craft to the catamaran craft 1*a* and 1*b* and/or one or more intermediate catamaran craft.

The intermediates coupling means comprise:

- intermediate aligning means adapted to make coaxial either a craft 1*c* with catamaran craft 1*a* and 1*b* and, if more than one intermediate catamaran craft 1*c* are present, the same intermediate catamaran craft 1*c;*
- intermediate coupling means for said first and second catamaran craft 1*a*, 1*b;*
- intermediate locking means adapted to make stable and rigid the coupling between craft 1*c* with at least one of the catamaran craft 1*a* and 1*b* and, if present more intermediate catamaran crafts 1*c*, between the same intermediate catamaran craft 1*c*; and, suitably,
- intermediate connectors and, more suitably,
- and, optionally, at least one intermediate seal both arranged to interpose between a craft 1*c* and at least one of the catamaran craft 1*a* and 1*b* and, if present more intermediate catamaran crafts 1*c*, between a pair of intermediate catamaran craft 1*c* avoiding the entry of water between the craft when mutually constrained by joining means and, preferably, compensating the deformations.

The intermediates coupling means are similar to the coupling means of the catamaran craft 1*a* and 1*b*. In detail, the intermediate aligning means are substantially analogous to the above described aligning means 10*a*, 10*b*, 11*a*, 11*b*, the intermediate coupling means are substantially analogous to the above described coupling means 12*a*, 12*b*, 13*a*, 13*b*, 14*a*, 14*b*, 15*a*, 15*b*, 16*a*, 16*b*, 17*a*, 17*b*, 18*a*, 18*b*, 19*a*, 19*b*. Intermediates locking means are substantially similar to the above-described locking means 20*a*, 20*b*, 21*a*, 21*b*, 22*a*, 22*b*, 23*a*, 23*b*, 24*a*, 24*b*, 25, 26*a*, 26*b*, 27*a*, 27*b*; the intermediate connectors are substantially similar to the above-described connectors; and the intermediate gasket is substantially similar to the above-described gasket.

Figure 15:
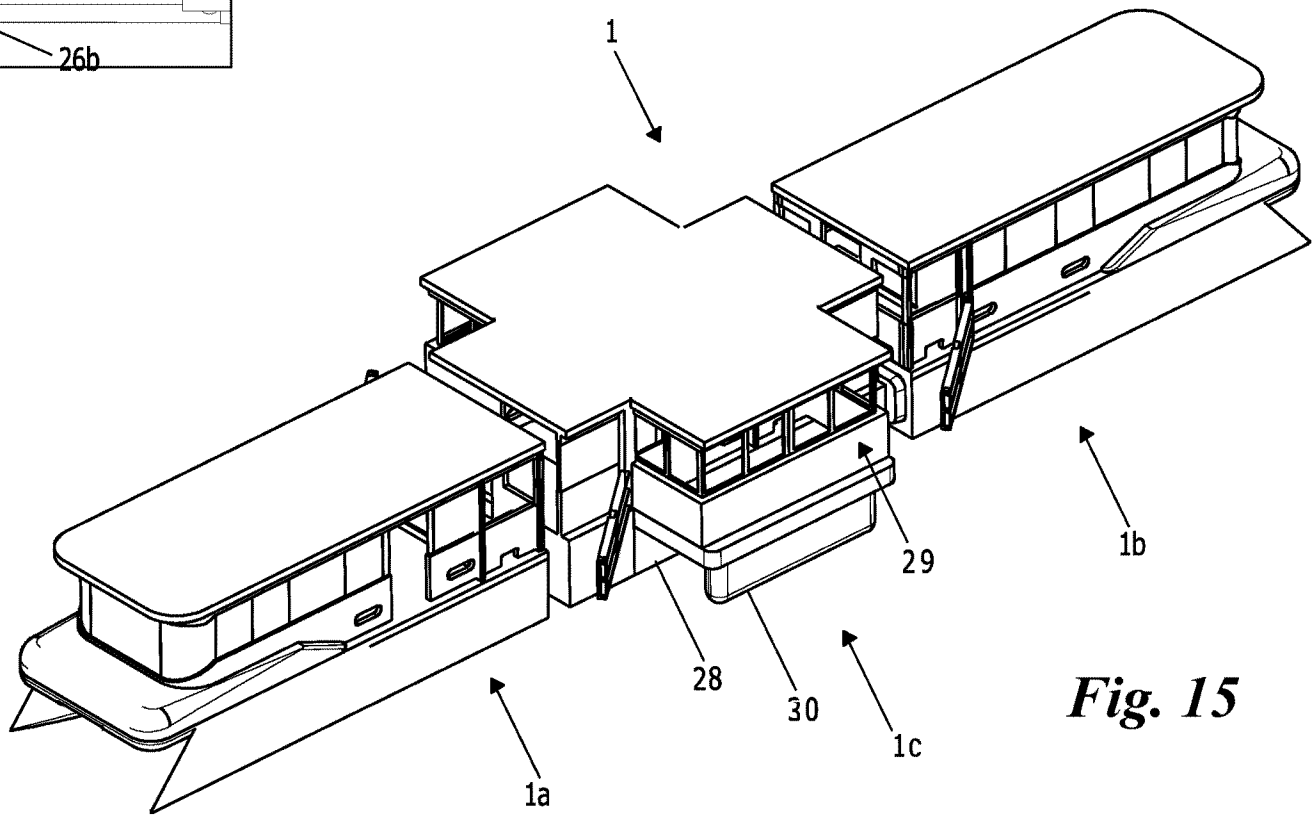
FIG. 15 shows another example of catamaran boat according to the invention.
Figure 14:
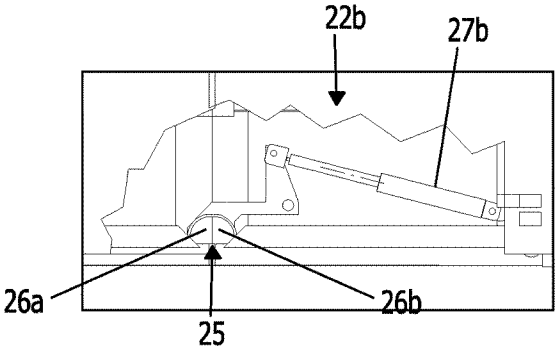
FIG. 14 shows a detail of FIG. 13.

Advantageously, as illustrated in FIG. 15, an intermediate catamaran craft 1*c* may comprise at least one additional intermediate hull 30 adapted to improve the stability of the catamaran boat 1. In particular, the intermediate catamaran craft 1*c* comprises at least one and, to be precise, exactly two intermediate additional hulls 30 located externally to the intermediate side hulls 28 and, in particular, on opposite sides of the intermediate side hulls 28, so as to enclose between them the same intermediate side hulls 28.

Said additional intermediate hulls 30 have a section that can suitably be smaller than the intermediate section of the side hulls 28.

The additional intermediates hulls 30 properly have a length smaller than the length of the intermediate side hulls 28. Alternatively, the additional intermediates hulls 30 suitably have a length at least equal and, specifically, greater than, the length of the intermediate side hulls 28.

Finally, in some cases, with reference to FIGS. 16 and 17 the catamaran boat 1 comprises a only catamaran craft acting independently and defining a bow 2, a stern 3 and a median axis x.

The catamaran craft comprises a catamaran hull and, in detail, two side hulls 100; a supporting structure 6 connecting the side hulls 100 and defining a supporting surface; motor means 4 adapted to generate a thrust force of the catamaran craft/boat and selectively placed in the bow 2 or stern 3; and directional means 5 adapted to define, properly together with the motor means 4, the direction of advance of the catamaran craft and, therefore, the catamaran boat 1 and placed on the opposite side of the motor means 4 and, therefore, selectively at the stern 3 or bow 2.

Particularly, the motor means 4 are at the bow 2 and the directional means 5 at the stern 3 (FIGS. 17*a* and 17*b*). Alternatively, the motor means 4 are at the stern 3 and the directional 5 at the bow 2 (FIGS. 16*a* and 16*b*).

The motor means 4 and directional means 5 are constrained to the structure 6 and, preferably, placed between the side hulls 100 and, more preferably, along the median axis x.

The motor means 4 comprise an azimuth thruster, conveniently, adapted to rotate on a thrust axis 4*c* substantially perpendicular to the supporting surface, thus changing the direction of the thrust force.

The directional means 5 comprise: a rudder blade, properly, arranged to rotate on a directional axis 5*c* substantially perpendicular to the supporting surface thus varying the direction of advance.

The axes 5*c* and 4*c* are substantially mutually parallel, in particular, they lie on a plane substantially parallel to the median axis x. Preferably, the axis 4*c*, 5*c* and *x* lie substantially on a single plane.

The axes 5*c* and 4*c* are substantially normal to the supporting surface.

The means 4 and 5 and, in particular, the azimuth thruster and the rudder blade are adapted to rotate independently one another, so as to allow the catamaran boat 1 selectively moving along a transverse direction and, in some cases, normal to the median axis x, advancing along the x axis or, almost roto-translating and, in particular, substantially rotating.

Preferably, the catamaran craft has a control station, wheelhouse, 110 suitably connected to the thrust means 4 and directional means 5 so as to command its direction and speed of advance and, therefore, said means.

The supporting structure 6 is called the bridge and is subtended/underlying between the side hulls, it connects the hulls themselves defining a supporting structure.

A structure, called superstructure, can be bound to the bridge from the top and formed by sidewalls 7 and a ceiling 8.

The side hulls 100 have both ends with a shape of known type and, in particular, tapered so as to facilitate the movements of the catamaran craft and, therefore, of the catamaran boat 1. Alternatively, the side hulls 100 have, as shown in FIG. 18, one end, preferably the bow 2, tapered and the other end, preferably the stern 3, non-tapered and, in particular, terminating with a flat face suitably and substantially perpendicular to the waterline.

The invention is susceptible of variations falling within the scope of the inventive idea. All of the details can be replaced by equivalent elements, and the materials, shapes and sizes can be of any nature and magnitude.

For example, the coupling means and the locking means may substantially coincide and, in particular, comprise at least one compression fitting (FIGS. 18, 19*a*, 19*b*).

Additionally, the units 1*a* and 1*b* may comprise additional reference means able to prevent a relative movement between the catamaran crafts 1*a* and 1*b* along a plane perpendicular to the axis x so as to allow the compression fitting to work almost exclusively for compression.

In particular, the first catamaran craft 1*a*, as shown in FIG. 18, comprises at least one first compression fitting 31*a* disposed at the stern 3*a*. Preferably, the first catamaran craft 1*a* comprises two first compression fittings 31*a* placed at stern 3*a*.

The first compression fitting 31*a*, as well as the second 31*b*, comprises a first coupling pin 311*b* integral with the second catamaran craft 1*b*; a first boom 312*a* having one end hinged to the first catamaran craft 1*a*; a first additional arm 313*a* provided with a first hook 314*a* committed to the first pin 311*b* and having the end, opposite to said first hook 314*a*, hinged to the first boom 312*a*; and a first linear actuator 315*a* having one end hinged to the first catamaran craft 1*a* and the other to the point of pivoting between the first arms 312*a* and 313*a*.

The first pin 311*b* is disposed in a second vane 18*b*.

The first arms 312*a*, 313*a*, the first hook 314*a* and the first linear actuator 315*a* are placed in a first seat 18*a*.

The first linear actuator 315*a* controls, as a function of its length variation (preferably an elongation), a mutual rotation of the first arms 312*a* and 313*a* respect to the first catamaran craft 1*a*.

Said rotation leads the first hook 314*a* outside the first seat 18*a* by placing it in the second seat 18*b* and, then, committing it to the first pin 311*b*.

Such commitment of the first hook 314*a* to the first pin 311*b* defines an articulated triangle in which the first boom is hinged, at its ends, to the first catamaran craft 1*a* and the first supplementary arm 313*a* which, in turn, is hinged through the first hook 314*a* to the first pin 311*b* and, then, to the second catamaran craft 1*b* (FIG. 19*a*).

At this point, the first linear actuator 315*a* performs a new length variation opposite to the previous one (preferably a contraction).

The contraction of the first linear actuator 315*a* imposes on first arms 312*a* and 313*a* a rotation in the opposite direction that combines and binds jointly the second catamaran craft 1*b* to the first catamaran craft 1*a* (FIG. 19*b*).

The second catamaran craft 1*b*, as shown in FIG. 18, comprises at least one compression fitting 31*b* arranged/placed at the stern 3*b* and, in particular, two compression fittings 31*b* placed at the stern 3*b*.

The second compression fitting 31*b* comprises a second pin 311*a* integral with the first catamaran craft 1*a*; a second boom 312*b* having one end hinged to the second catamaran craft 1*b*; a second additional arm 313*b* equipped with a second hook 314*b* committed to the second pin 311*a* and having the end, opposite to said second hook 314*b*, hinged to the second boom 312*b*; and a second linear actuator 315*b* having one end hinged to the second catamaran craft 1*b* and the other to the point of pivoting between the second arms 312*b* and 313*b*.

The second pin 311*a* is disposed in a first seat 18*a*.

The second arms 312*b*, 313*b*, the second hook 314*b* and the second linear actuator 315*b* are placed in a second seat 18*b*.

The second linear actuator 315*b* controls, as a function of its length variation (preferably an elongation), a mutual rotation of the second arms 312*b* and 313*b* respect to the second catamaran craft 1*b*.

Said rotation leads the second hook 314*b* outside the second seat 18*b* by placing it in the first seat 18*a* and, then, committing it to the second pin 311*a*. Such commitment of the second hook 314*b* to the second pin 311*a* defines an articulated triangle in which the second boom 312*b* is hinged, at its ends, to the second catamaran craft 1*b* and the second additional arm 313*b* which, in turn, is hinged, through the second hook 314*b* to the second pin 311*a* and, then, to the first catamaran craft 1*a* (FIG. 19*a*).

At this point, the second linear actuator 315*b* performs a new length variation opposite to the previous one (preferably a contraction).

The contraction of the second linear actuator 315*b* imposes on second arms 312*b* and 313*b* a rotation in the opposite direction that combines and binds solidly the first catamaran craft 1*a* to the second catamaran craft 1*b* (FIG. 19*b*). The additional reference means of each catamaran craft 1*a*, 1*b* comprise on its external stern bulkhead 9*a*, 9*b* an additional truncated pyramid structure that protrudes to the outside of the stern 3*a*, 3*b* and a supplementary recess complementarily to the additional truncated pyramid structure so as to house inside the additional truncated pyramid structure, preventing a relative movement between the catamaran crafts 1*a* and 1*b* along a plane perpendicular to the median axis x.

The additional truncated pyramid structure and the supplementary recess have complementary section so as to cooperate substantially by contact of the respective inclined planes during the headway.

The invention claimed is:

1. A catamaran boat comprising:

a first catamaran craft that works independently, having a main direction of longitudinal development along a median axis (x) and comprising a bow, a stern, motor means and direction means;

a second catamaran craft that works independently, having a main direction of longitudinal development along a median axis (x) and comprising a bow, a stern, motor means and direction means, wherein both said first catamaran craft and said second catamaran craft comprise coupling means for their mutual stable connection, obtained by fitting their sterns together, on a transverse junction plane (Π), in order to realize said catamaran boat adapted to work as a single unit.

2. The catamaran boat according to claim 1, wherein:

said motor means comprise an azimuth thruster, provided on each catamaran craft at bow;

said direction means comprise a rudder blade provided on each catamaran craft at stern, wherein said motor means and the direction means are provided along said median axes (x).

3. The catamaran boat according to claim 1, wherein said first catamaran craft and said second catamaran craft are identical and the hull resulting from their coupling is substantially symmetrical with respect to the transverse junction plane (Π).

4. The catamaran boat according to claim 1, wherein said coupling means comprise:

aligning means adapted to make the first and the second craft coaxial;

coupling means for said first and second craft;

locking means adapted to make the coupling of said first and second craft stable and rigid.

5. The catamaran boat according to claim 4, wherein said aligning means comprise shape-coupling means provided at said sterns.

6. The catamaran boat according to claim 4, wherein said coupling means work along the main direction of longitudinal development of said first and said second craft and include a movable hook provided on each craft, configured to interact with a respective retaining element provided on the opposite craft.

7. The catamaran boat according to claim 4, wherein said locking means comprise a panel rotationally associated with each craft and configured to rotate in order to be firmly fixed to the opposite craft.

8. The catamaran boat according to claim 4, wherein said locking means comprise a jaw hook provided a cover wall of each craft and configured to engage a respective retaining element obtained by the coupling of said first and said second craft.

9. The catamaran boat according to claim 8, wherein said jaw hook comprises a hydraulic piston configured to exert a force to the jaw in order to clasp said retaining element.

10. The catamaran boat according to claim 2, wherein the azimuth thrusters of said first and said second craft rotate independently around their axis to ensure the handling of said craft.

* * * * *